United States Patent [19]

Kurakake

[11] Patent Number: 4,704,933

[45] Date of Patent: Nov. 10, 1987

[54] APPARATUS FOR AND METHOD OF PRODUCING AUTOMATIC MUSIC ACCOMPANIMENT FROM STORED ACCOMPANIMENT SEGMENTS IN AN ELECTRONIC MUSICAL INSTRUMENT

[75] Inventor: Yasushi Kurakake, Hamamatsu, Japan

[73] Assignee: Nippon Gakki Seizo Kabushiki Kaisha, Hamamatsu, Japan

[21] Appl. No.: 813,495

[22] Filed: Dec. 26, 1985

[30] Foreign Application Priority Data

Dec. 29, 1984 [JP] Japan ..... 59-276696

[51] Int. Cl.[4] ..... G10H 1/42; G10H 7/00

[52] U.S. Cl. ..... 84/1.03; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS 4,217,804 8/1980 Yamaga et al. ..... 84/1.03
4,282,788 8/1981 Yamaga et al. ..... 84/1.03
4,326,441 4/1982 Imamura et al. ..... 84/1.03

*Primary Examiner*—Stanley J. Witkowski
*Attorney, Agent, or Firm*—Spensley Horn Jubas & Lubitz

[57] ABSTRACT

The accompaniment apparatus for an electronic musical instrument comprises an accompaniment segment memory storing data representing a plurality of accompaniment segments which form a plurality of mutually different accompaniment patterns of predetermined lengths, and an alignment sequence memory storing, separately from the above, the orders with which these accompaniment segments are to be aligned sequentially. The data of these orders of alignment of segments are read out one after another, on the basis of which the accompaniment segments derived from the data of the segment memory are aligned one after another sequentially at a given tempo. This operation materializes the automatic accompaniment of any substantial length such as one whole piece of music, and allows the segment memory to have a capacity much smaller as compared to the case in which accompaniment patterns for the whole length of music have to be stored without skipping these segments of the same pattern.

21 Claims, 7 Drawing Figures

APPARATUS FOR AND METHOD OF PRODUCING AUTOMATIC MUSIC ACCOMPANIMENT FROM STORED ACCOMPANIMENT SEGMENTS IN AN ELECTRONIC MUSICAL INSTRUMENT

BACKGROUND OF THE INVENTION (a) Field of the Invention

The present invention relates to an apparatus for and a method of automatically producing accompaniment such as bass, chord and arpeggio tones in an electronic musical instrument, and more particularly it pertaines to the apparatus for and the method of the type mentioned above for materializing complicated accompaniment with a relatively small amount of memory data, by storing data representing a plurality of accompaniment segments forming a plurality of mutually different accompaniment patterns of predetermined lengths, and by storing, separately from the above, the orders with which these accompaniment segments are to be aligned sequentially.

(b) Description of the Prior Art

In the past, there has been known an automatic accompaniment apparatus having a keyboard provided with a plurality of keys and being installed in an electronic musical instrument and being designed so that an accompaniment data for one to two bars (measures) are stored, and that these accompaniment data are read out repetitively in accordance with the progression of the keyboard performance while being added with key depression data to thereby generate such tone signals as bass, chord or arpeggio.

According to the above-described prior art, the accompaniment data has a length extending to only one to two bars, and thus the accompaniment has tended to become monotonous. For example, U.S. Pat. No. 4,217,804 discloses an automatic accompaniment apparatus wherein an arpeggio pattern constituting two bars is simply repeated in accompaniment. Examples of an arpeggio pattern are shown in FIGS. 12(*a*) to 12(*c*) therein. Similarly, in an electronic musical instrument shown in U.S. Pat. No. 4,282,788 an automatic accompaniment apparatus is disclosed. More precisely, examples of a chord performance rhythm pattern of two bars are disclosed in FIG. 4 therein. In an automatic chord performance, such rhythm pattern is performed repetitively.

In order to materialize a complicated accompaniment performance, therefore, consideration may be made to storing a lengthy sequential train of accompaniment data extending to a number of bars. Such a lengthy train of accompaniment data, however, has led to a substantial increase in the amount of data requiring to be stored.

SUMMARY OF THE INVENTION

It is, therefore, the primary object of the present invention to provide an apparatus for and method of producing automatic accompaniment for an electronic musical instrument of keyboard type, which is capable of producing an automatic accompaniment for a lengthy music piece with a limited capacity of memory.

Another object of the present invention is to provide an automatic accompaniment apparatus of the above-mentioned type capable of making an accompaniment rich in variation.

A further object of the present invention is to provide an automatic accompaniment apparatus of the type mentioned above which, for the above-mentioned reasons, can be manufactured at a small cost.

According to the present invention, the above-mentioned objects can be attained by the apparatus designed to store, in a memory of a relatively small capacity, data representing a plurality of accompaniment segments which form a plurality of mutually different accompaniment patterns of predetermined lengths, and to store separately from the above the orders with which these accompaniment segments are to be aligned sequentially, and to read out these orders of alignment of segments one after another as a command of alignment, on the basis of which the accompaniment segments derived from the stored data of segments are aligned one after another sequentially at a given tempo with the progression of the music, whereby enabling the generation of accompaniment tones for a lengthy piece of music, while allowing the segment memory to have a limited small capacity because the same segment data representing the same accompaniment pattern which appears in various portions of a music piece can be used repetitively by reading out from the memory.

More specifically, the automatic accompaniment apparatus in an electronic musical instrument according to the present invention fundamentally comprises:

tempo clock generator generating tempo clock pulses determining a tempo of an automatic accompaniment performance;

an accompaniment data memory constructed by an accompaniment segment memory and an alignment sequence memory, said accompaniment segment memory storing segment data representing a plurality of accompaniment segments which form a plurality of mutually different accompaniment patterns of predetermined lengths and said alignment sequence memory storing, separately from the above, order data representing orders with which the accompaniment segments are to be aligned sequentially;

alignment sequence reading-out circuit reading out the order data one after another;

segment reading-out circuit reading out the plurality of accompaniment segments in the order designated by the order data in accordance with the tempo clock pulses to thereby align the read-out segment data in the order thus read out; and accompaniment tone generator generating an accompaniment tone signal corresponding to the read-out segment data.

The automatic accompaniment apparatus of the invention is used for an electronic musical instrument which has a plurality of keys, and the segment data stored in the accompaniment segment memory are read out selectively by depressing one or more of said keys. A chord type detector is provided to detect a chord type upon operation of one or more of the keys. The segment data or the order data read out, may correspond to the detected chord type. Also, a rhythm selector is provided for selecting a rhythm out of a plurality of stored rhythms. The segment data stored in the accompaniment segment memory or the order data stored in the alignment sequence memory are read out selectively in accordance with the selected rhythm.

In the automatic accompaniment apparatus, the order data stored in the alignment sequence memory are read out selectively by depressing one or more of the keys. The accompaniment tone generator generates accompaniment tone signals according to depressed one or more of the keys. The accompaniment segment data may be stored in the form of degree. In this case, the automatic accompaniment apparatus includes root note detecting means for detecting a root note by depressing one or more of keys. The accompaniment tone signals correspond to a modified segment data formed by modifying the data of accompaniment segments in accordance with the detected root note. Also, the data of accompaniment segments may represent a specific key (e.g. the highest key) among depressed one or more of keys.

The tempo clock pulses are generated at a time period, for example, corresponding to an eighth note so that the segment data is read out at such time period. To conform the apparatus to a practical application, the accompaniment tone generator comprises a delay circuit for delaying the segment data by a time length, for example, corresponding to a sixteenth note so that the accompaniment tone signal is generated at the timing of the sixteenth note. Also, for instance, each of the segments consists of a length of music score corresponding to at least one bar, and the tempo clock pulses are generated at every period corresponding to a 32nd note.

In another aspect of the present invention, the method of automatically producing accompaniment in an electronic musical instrument comprises the steps of:

reading out order data from alignment sequence memory means of the musical instrument;

reading out a plurality of accompaniment segment data from accompaniment segment memory means of the musical instrument in the order designated by the order data in accordance with a given tempo to thereby align the read-out segment data in the order thus read out; and generating an accompaniment tone corresponding to the resulting aligned accompaniment segment data.

The method may further comprise a step of selecting a rhythm, and the accompaniment tone is generated based on the selected rhythm.

Let us here assume that said plurality of accompaniment segments representing a plurality of accompaniment patterns of predetermined lengths consist of four different segments or coded names of patterns A, B, C and D. According to the arrangement of the present invention, these four individual patterns constituted by the four different segments may be combined together in any appropriate fashion to materialize a lengthy train of complicated accompaniment segments or patterns such as A-B-A-C-A-B-A-D, whereby the generation of accompaniment tones rich in variation becomes feasible.

Also, according to the present invention, the coded data of accompaniment segments representing the respective accompaniment pattern names are read out one after another from the accompaniment segment memory of an accompaniment data memory unit, so that regardless of how many times the same pattern or segment may appear during the progression of the music piece, it is only necessary for this accompaniment segment memory to store the data of the same segment or a same pattern once. In other words, the data of any one segment (pattern) can be utilized in common and repetitively in a plurality of performance sections of a music piece if this music is composed in such a way that the same accompaniment pattern or patterns occur at various portions thereof. Thus, the present invention can save a substantial amount of data to be stored in the accompaniment segment memory means.

These as well as other objects of the present invention will become apparent during the course of the following detailed description and appended claims.

DETAILED DESCRIPTION OF THE PREFERRED EMBODIMENT

Figure 1:
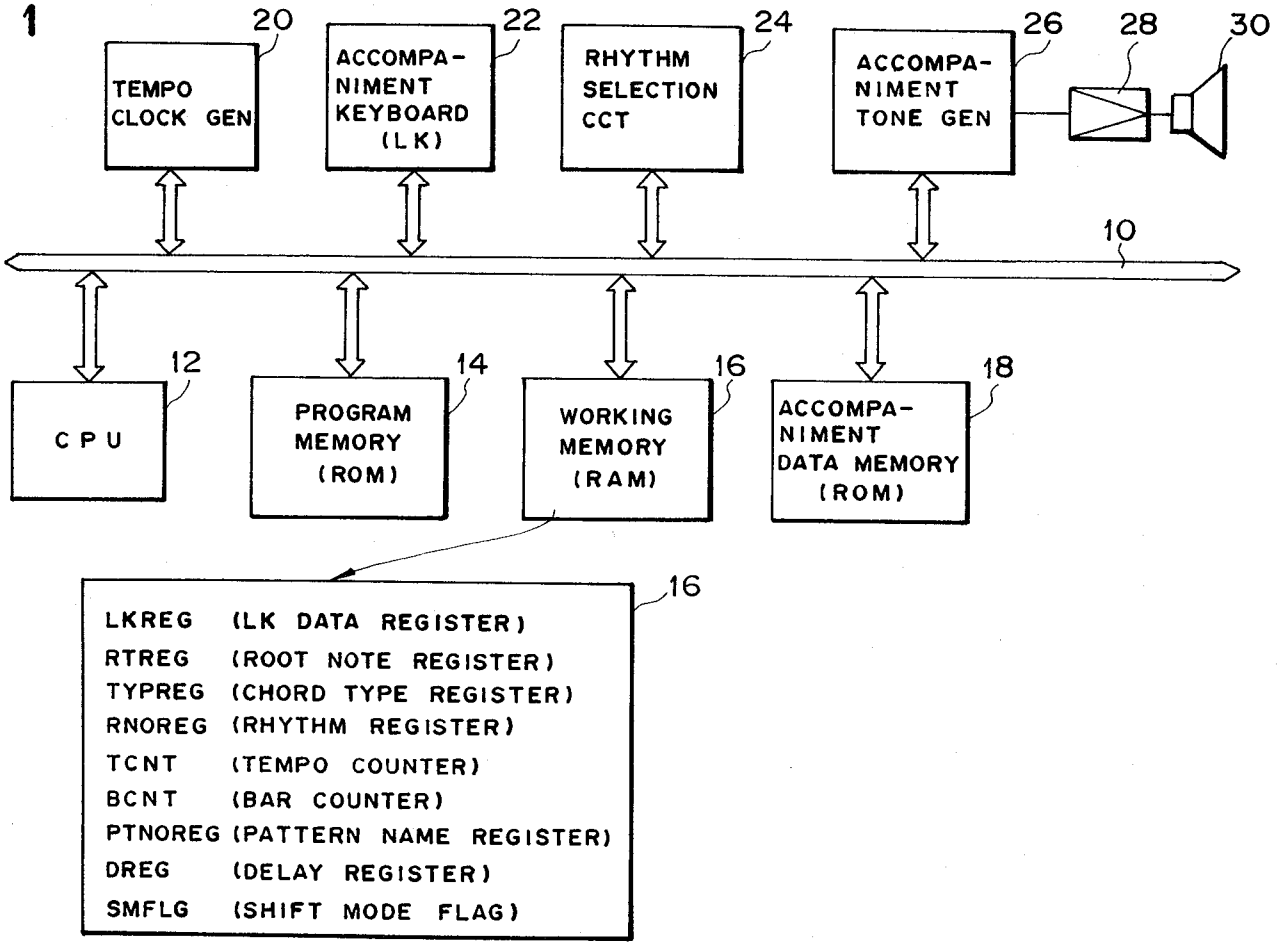
FIG. 1 is a block diagram showing the circuit arrangement of the automatic accompaniment apparatus in an electronic music instrument according to one embodiment of the present invention.

FIG. 1 shows the circuit arrangement of automatic accompaniment apparatus suitable for being incorporated in an electronic musical instrument of a keyboard type according to one embodiment of the present invention.

To a common bus 10 are electrically connected a central processing unit (CPU) 12, a program memory 14, a working memory 16, an accompaniment data memory unit 18, a tempo timer 20, an accompaniment keyboard 22, a rhythm selection circuit 24 and an accompaniment tone forming circuit 26.

The CPU 12 carries out various data processing as well as various control processing in accordance with the program stored in the program memory which is comprised of a ROM (Read-Only Memory). With respect to various kinds of processing to be carried out for the generation of accompaniment tones, their description will be made later by referring to FIGS. 5 and 6.

The working memory 16 is comprised of RAM (Random Access Memory). With respect to the generation of accompaniment tones, this working memory contains parts which function as various kinds of registers, counters, flags and so forth as shown in FIG. 1. The details of these respective functional parts will be described later also.

The accompaniment data memory unit 18 is comprised of a ROM. This memory unit contains an accompaniment segment memory storing coded data which represent a plurality of accompaniment segments which form a plurality of mutually different accompaniment patterns of predetermined lengths, and an alignment sequence memory storing, separately from the above, the order or sequence with which these accompaniment segments are to be aligned sequentially. With respect to the data formats of these two memories, description will be made later by giving reference to FIGS. 2A and 3.

The tempo timer 20 generates interrupt command signals (a sort of tempo clock signals) every period corresponding to the 32nd note in accordance with a given tempo. Upon each generation of this interrupt command signal, the interrupt routine of FIG. 6 commences.

The accompaniment keyboard 22 contains a number of keys and key switches provided under the respective keys, and in ordinary double keyboard type electronic musical instruments, the accompaniment keyboard is comprised of the lower keyboard. It should be noted here that the "accompaniment keyboard" will hereunder be briefly called "LK" for the sake of simplicity.

The rhythm selection circuit 24 is intended to select an arbitrary rhythm such as march, waltz, swing and rumba, and it contains rhythm selection switches corresponding to these respective types of rhythm.

The accompaniment tone forming circuit 26 forms accompaniment tone signals based on a key or keys depressed on the LK 22 and also on the data read out from the alignment sequence memory of the accompaniment data memory unit 18. These accompaniment tone signals are supplied, via an output amplifier 28, to a loudspeaker 30 to be sounded out therefrom as accompaniment tones.

WORKING MEMORY 16

The functions of the various kinds of registers, counters, flags and like parts in the working memory 16 are as described in items (1) to (9) given below.

(1) LK Data Register (LKREG)

This register is intended to store key depression data corresponding to the keys depressed on LK 22 so as to store data for four notes of higher pitches among them. In storing such data, certain specific one octave is set as a specific octave range, and for a key depression data corresponding to those keys depressed outside this specific octave range, the octave of these depressed keys is shifted so as to be contained in the specific octave range.

(2) Root Note Register (RTREG)

This register is intended to store the root note data representing the root note of a chord.

(3) Chord Type Register (TYPREG)

This register is intended to store chord type data representing individual types of chords such as major, minor, seventh and so on. In storing such data, the chord type is detected based on the key depression data corresponding to those keys depressed on LK 22. Depending on the manner of key depression on LK 22, however, there could occur that the detection of the chord type is not possible (i.e. chord is not detected). In such a case, "chord is not detected" is handled as a kind of chord type, and a chord type data corresponding thereto is written in this register.

(4) Rhythm Type Register (RNOREG)

This register is intended to store rhythm data representing a specific rhythm such as waltz when so selected in the rhythm selection circuit 24.

(5) Tempo Counter (TCNT)

This counter is designed to be operative so that its count value gains "one" each time a tempo interrupt command signal is generated by the tempo timer 20 for every 32nd note, and that when its count value gains "32", the count value of the counter is cleared. That is, if one bar is assumed to consist of thirty-two beats, the count value of the tempo counter TCNT at a given time corresponds to the number of beats occurred.

(6) Bar Counter (BCNT)

Bar counter is intended to count the number of bars. Each time the count value of the tempo counter TCNT gains "32", the counter makes "1" count up, and when the count value gains "8", the count value of the counter is cleared.

(7) Pattern Name Register (PTNOREG)

This register is intended to store coded accompaniment pattern name data for eight bars, which data representing the coded accompaniment pattern name for each bar. The pattern name data stored in this register is read out from the segment memory of the accompaniment data memory unit 18.

(8) Dalay Register (DREG)

This register is intended to store data for four 8-th notes among the alignment sequence data covering one bar. The data stored therein are those read out from the alignment sequence memory of the accompaniment data memory unit 18.

(9) Shift Mode flag (SMFLG)

This is a register for storing one-bit data. If the content of this register is "1", the flag indicates the Shift Mode, whereas if the counter is "0", the flag indicates the Normal Mode. This Normal Mode herein used is one which is employed for the generation of the accompaniment tones corresponding to the key depression data written in the LK data register LKREG, while the Shift Mode is one which is for the generation of accompaniment tones not directly corresponding to the key depression data written in the LK data register LKREG by shifting the tone pitches with the addition of interval data to the root tone data.

ACCOMPANIMENT DATA MEMORY UNIT 18

Figure 2A:
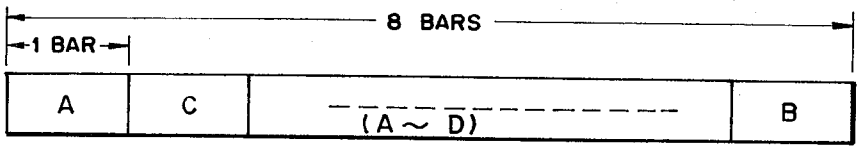
FIG. 2A is a data format chart of an alignment sequence of accompaniment segments.

In the accompaniment segment memory of the accompaniment data memory unit 18 are stored, as shown in FIG. 2A, segment data for consecutive eight bars, which data being indicative of either one of the coded accompaniment segments corresponding to patterns A to D for each bar which may represent a segment, in an amount up to a maximum of: the number of rhythm x the number of chord types. In other words, the data format of a series of coded accompaniment patterns (consisting of segments) shown in FIG. 2A corresponds in this example to a certain specific rhythm such as "waltz" and to a certain specific chord type such as "major". For each different rhythm and/or chord type, such a series of coded pattern name data as mentioned above as an example is stored. It should be noted here that this segment memory may read out and store such segment (pattern) data wherein several or all of the rhythms or chord types in one music piece are identical.

Figure 2B:
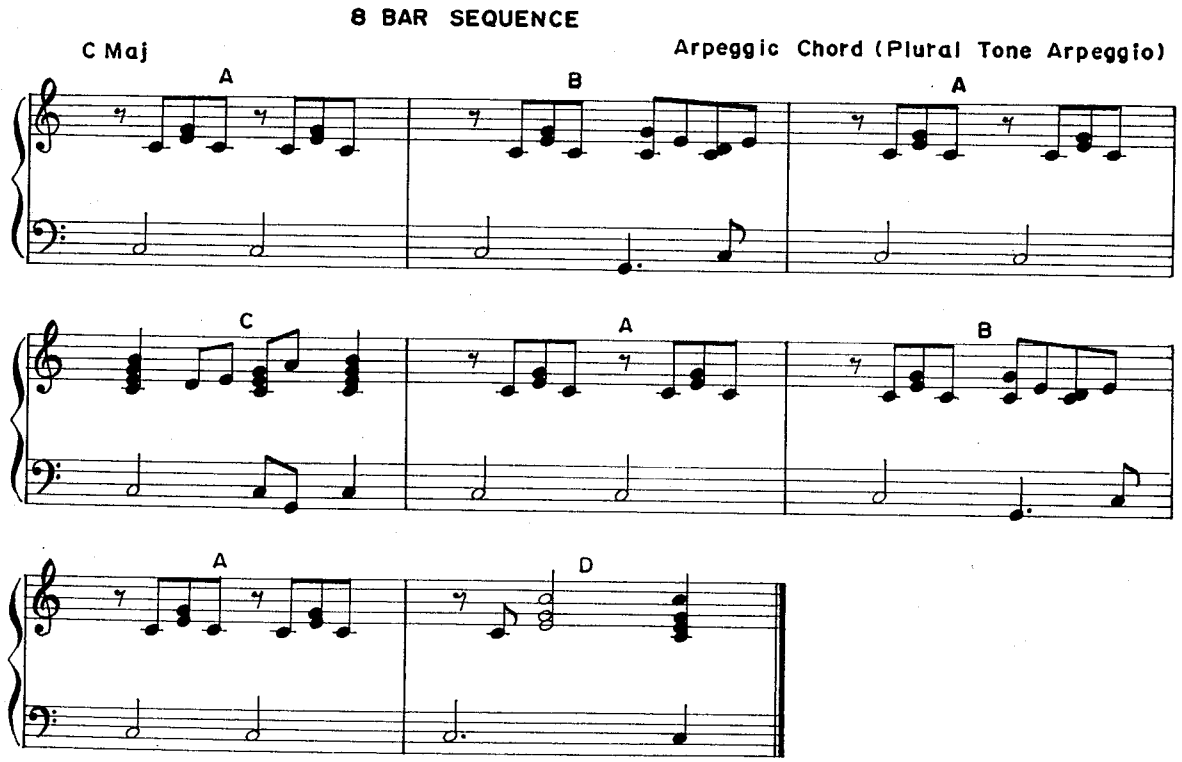
FIG. 2B is a music score showing an example of accompaniment having an alignment sequence A-B-A-C-A-B-A-D.
Figure 3:
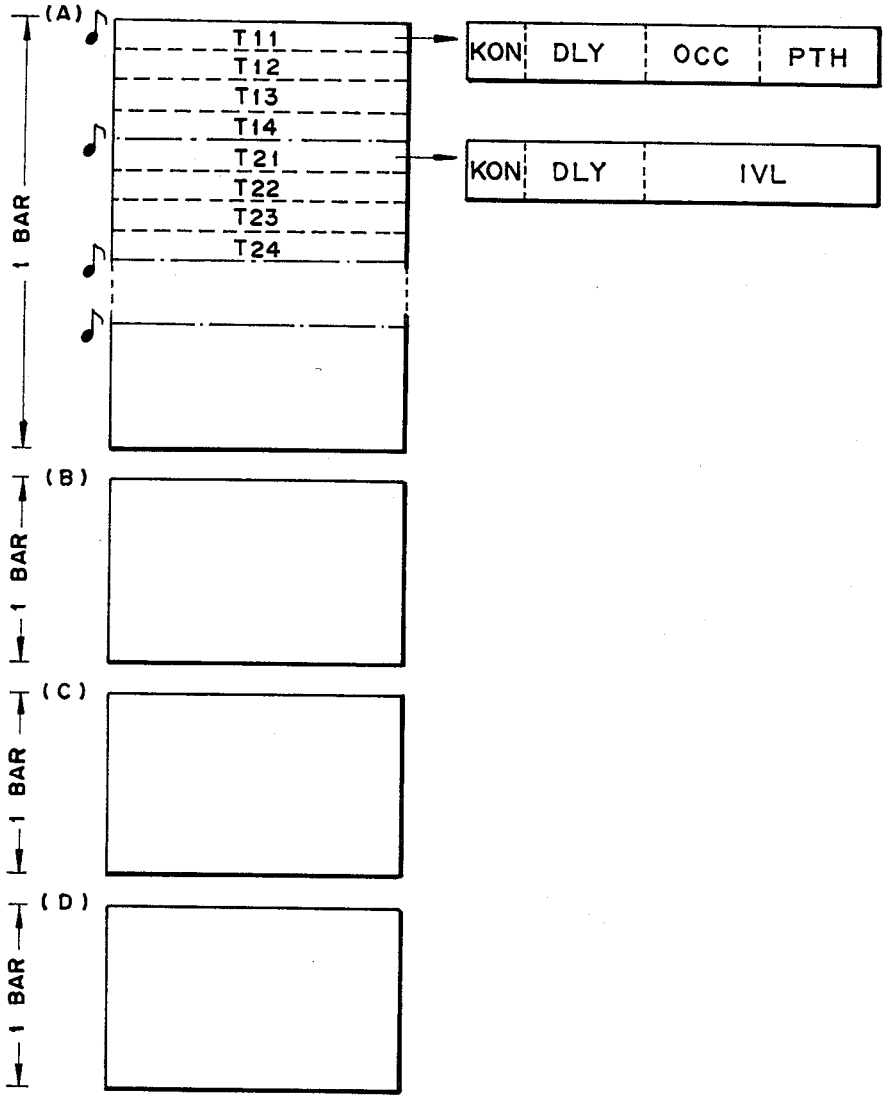
FIG. 3 is a data format chart showing data contents of accompaniment segments.

The alignment sequence memory of the accompaniment data memory unit 18, as shown in FIG. 3, stores correspondingly to the above-mentioned accompaniment patterns A, B, C and D in this example, data of four kinds of alignment sequence, i.e. orders, with which accompaniment segments are to be aligned, in an amount up to a maximum of: the number of rhythms x the number of chord types. In other words, the data of these four kinds of alignment sequence shown in FIG. 3 corresponds to any specific rhythm such as "waltz" and also to any specific chord type such as "major". For each different rhythm type or chord type, the data of such four kinds of sequence of alignment as that mentioned above by way of example are stored. FIG. 2B shows a music score showing an example of accompaniment for facilitating the understanding of the above statement. As will be noted from this Figure, respective bars can be constituted by coded names of segments such as A, B, C and D. The music score mentioned therein is for the "8-beat" rhythm, and the chord type is "major". Here again, the alignment sequence memory may read out and store the data of the four kinds of alignment sequence wherein several or all of the ryhthms or chord types are identical in a music piece.

In FIG. 3, let us here suppose four storage regions or sections storing four kinds of alignment sequence data, respectively. The data representing the top-leading addresses of the respective storage regions or sections are the data representing the accompaniment segments corresponding respectively to the above-mentioned accompaniment patterns A to D. That is, the respective storage section data indicative of corresponding patterns shown in FIG. 2A are comprised of those data indicative of the top-leading addresses of the storage regions which store the alignment data corresponding to the respective patterns.

On the other hand, the data concerning the respective kinds of alignment sequence are, more concretely, each designed in such a way, as shown in FIG. 3 typically by the data corresponding to the accompaniment pattern A, that the accompaniment tone generation pattern for one bar is indicated by four 8-th notes T11~T14, T21~T24 and so on. In this case it is possible to arrange so that the data for the Normal Mode for every 8-th note and the data for the Shift Mode for every 8-th note are contained jointly in the alignment sequence data for one bar. As an example of such an arrangement, the data T11~T14 corresponding to the initial 8-th note is assigned for the Normal Mode, while the data T21~T24 corresponding to the second 8-th note is assigned for the Shift Mode. Then, the data formats for one note in these two types of modes, respectively, become as shown typically with respect to the data T11 and T21 in FIG. 3.

More particularly, the data for one note for the Normal Mode contains, as shown with respect to the data T11, key-on event data KON, delay data DLY, octave data OCC and tone pitch position data PTH. Also, the data for one note for the Shift Mode contains, as shown with respect to the data T21, key-on event data KON, delay data DLY and interval data IVL.

In each of the data for the Normal Mode and the Shift Mode, key-on event data KON is assigned to indicate Yes or No of the need to sound out, and this is indicated by one bit. If sounding-out of a tone is needed, this is represented by "1" and if not, it is indicated by "0".

Figure 4:
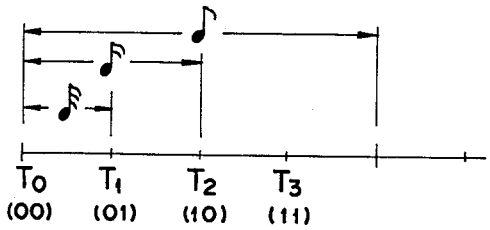
FIG. 4 is a time chart for explaining sounding-out timings for an 8-th note section.

Also, in each of the data for the Normal Mode and the Shift Mode, the delay data DLY indicates, by two bits, at which timing $T_0 \sim T_3$ in the period corresponding to the 8-th note duration as shown in FIG. 4 the sounding-out is to be effected. If the indication is "00", the sounding-out is to take place at $T_0$; if "01", at $T_1$; if "10", at $T_2$, and if "11", at $T_3$. By the provision of such a delay data DLY as mentioned above, it should be noted that, in the period corresponding to the duration of the 8-th note, sounding-out becomes feasible by utilizing the function of dividing into 32nd notes. However, with respect to the data such as T11, T21, etc. of the initial note among the data of the four 8-th notes, arrangement is made so that, out of the two bits of the delay data DLY of such an initial note, the LSB (least significant bit) is designed as the mode-instruction bit so that if this bit is "1", the Shift Mode is indicated, and if "0", the Normal Mode is indicated. For this reason, with respect to the data of the initial note, there could appear such an instance that only the dividing function into 16th note is available. Nevertheless, in view of the tendency that the 32nd note occurs at a very low frequency, and moreover, because of the fact that the dividing function into 32nd notes can be utilized for the data of the second to the fourth notes, there should arise no problem from the practical point of view.

In the data for the Normal Mode, the octave data OCC shows an octave relative to a specific octave (specific octave range) which has been preliminarily set with respect to the key depression data stored in the LK data register LKREG. Also, the tone pitch position (order) data PTH is intended to indicate at which position of the tone pitch order the note requiring sounding-out stands as counted from the highest pitch note in the tone pitch arrangement, by designating its position number from the higher pitch note side of the data stored in the LK data register LKREG. For example, if the tone pitch position data PTH indicates the position "1" in the pitch arrangement, this means that the highest pitch note stored in LKREG is to be sounded out. It should be understood here also that if all bits of the tone pitch sequence data PTH are "0", this means that the tone being sounded out is to be terminated (key-off).

In the data for the Shift Mode, the interval data IVL is intended to represent an interval such as the third degree relative to the root note data stored in the root note register RTREG. If this data is such that all bits thereof are "0", this means "key-off" as in the above-mentioned case of the tone pitch position data PTH.

In the example shown in FIG. 3 described above, data for the Normal Mode and data for the Shift Mode are jointly present in the data of the orders for aligning accompaniment segments. It should be understood, however, that the data of the orders for aligning segments for the instance of "chord is not detected" which is a kind of chord type as stated above is prepared only with the data for the Normal Mode. This is because of the consideration that, in case of the instance of "chord is not detected", the detection of the root note becomes impossible also, so that there never happens that an accompaniment tone is generated in the Shift Mode.

MAIN ROUTINE

Figure 5:
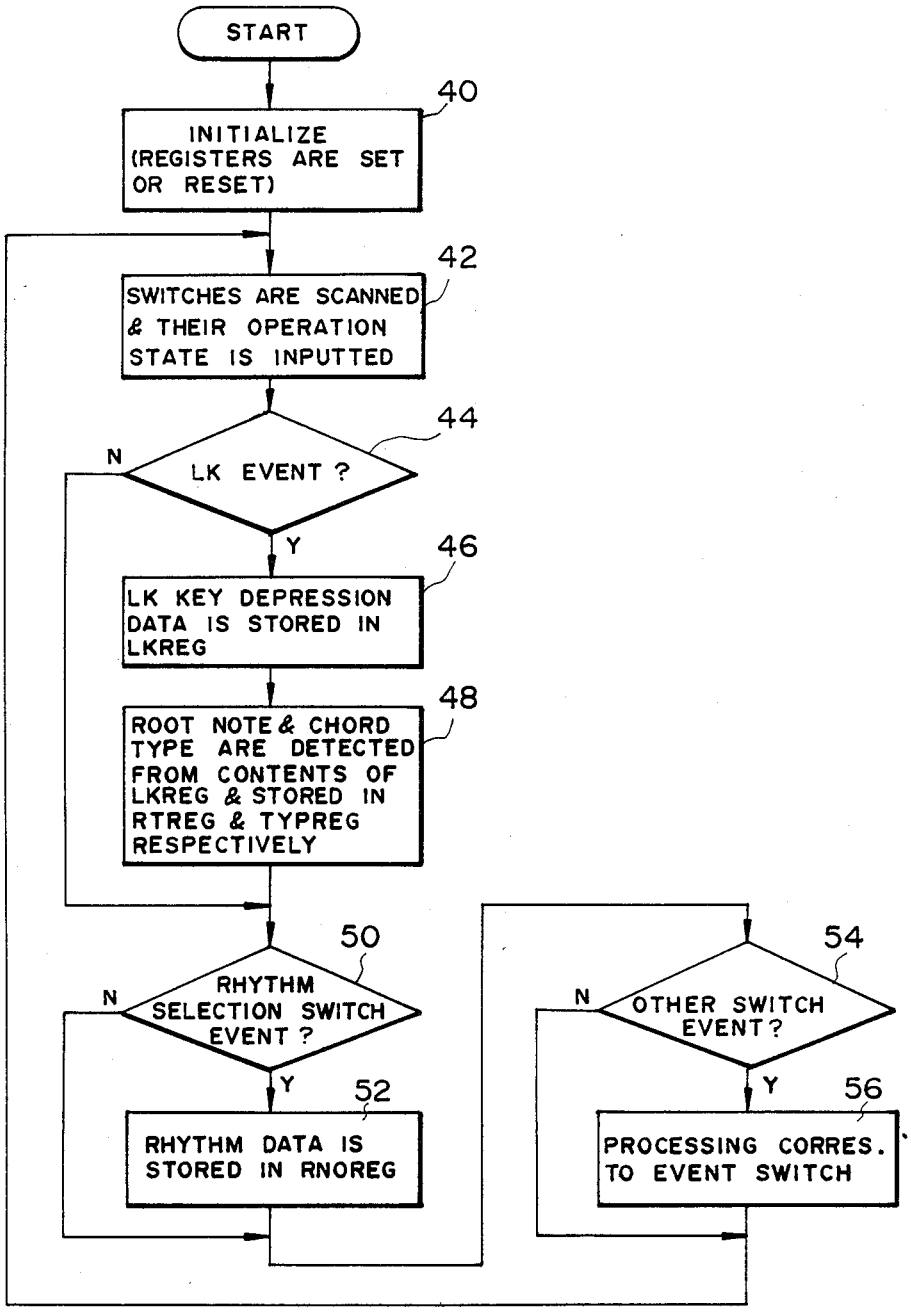
FIG. 5 is a flow chart showing a main routine operation concerning the generation of an accompaniment tone.

Description will next be directed to the processing by Main Routine concerning the generation of accompaniment tones by referring to FIG. 5.

As a first step, a start switch not shown is turned on. Whereupon, an "initial set" processing is carried out in Step 40 to set or reset various registers, etc. contained in the working memory 16 in FIG. 1. More specifically, a count value "7" is set in the bar counter BCNT, and along therewith, LK data register LKREG, the root note register RTREG, the chord type register TYPREG, the rhythm register RNOREG, the pattern (segment) name register PTNOREG, the delay register DREG and the Shift Mode flag SMFLG are reset (cleared), respectively.

Next, in Step 42, the key switches of LK 22, the rhythm selection switches of the rhythm selection circuit 24, and other switches not shown are scanned, and their respective key state informations are inputted. And, in Step 44, judgment is made as to whether or not there is a change in the state of the key switches of LK 22 (presence or absence of LK event), and if the result of judgment is Yes (Y), processing moves over to Step 46.

In step 46, the key depression data corresponding to the keys depressed on LK 22 are written in LKREG one after another in the order of the keys having higher tone pitches. In this case, with respect to the key depression data corresponding to those keys depressed outside the predetermined specific octave range, their data are written in after shifting their octave so as to be contained in said predetermined specific octave range. And, in Step 48, the root note as well as the type of the chord are detected based on the key depression data registered in LKREG, and the root note data and the chord type data thus obtained are written in RTREG and TYPREG, respectively. In such an instance, if the detection of the chord type is not possible, the chord type data corresponding to "chord is not detected" is written in TYPREG. However, no data is written in RTREG since the detection of the root note is not possible. Thereafter, processing moves over to Step 50. It should be noted here that, if the result of judgment in Step 44 indicates that there is no LK event (N), processing moves directly over to Step 50 without going through Steps 46 and 48.

In Step 50, whether there is a change (event) is the state of operation of the rhythm selection switches is judged, and if the result is Yes (Y), processing moves over to Step 52. And, in Step 52, the rhythm type representing the specific rhythm type corresponding to the operated rhythm selection switch is written in RNOREG. Thereafter, processing moves over to Step 54. It should be noted here that, if the result of judgment in Step 50 is "no event" (N), processing moves directly over to Step 54 without going through Step 52.

In Step 54, judgment is made as to whether there is a change (event) in the operation state of those switches other than the key switches and the rhythm selection switches, and if the result is Yes (Y), processing moves over to Step 56, and after carrying out processing corresponding to the switches which have experienced an event, processing returns to Step 42. And, likewise, if the result of judgment in Step 54 is "no event" (N), processing returns to Step 42 without going through Step 56.

Thereafter, such a series of processing as described above are repeated. When, however, there is generated an interrupt command signal by the tempo timer 20, i.e. when there is applied a tempo interrupt, the interrupt routine of FIG. 6 commences.

INTERRUPT ROUTING

Figure 6:
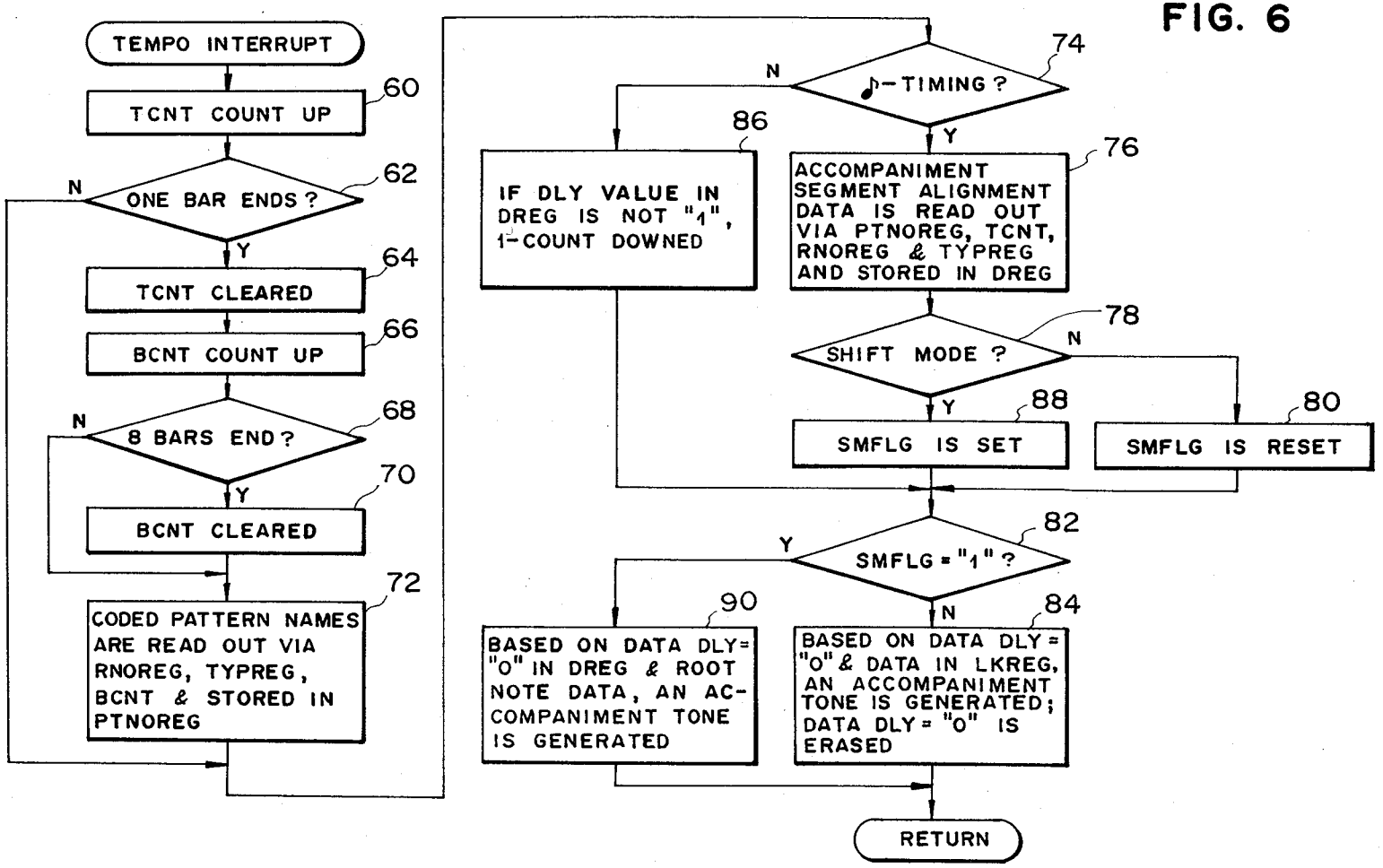
FIG. 6 is a flow chart showing an interrupt routine operation concerning the generation of an accompaniment tone.

In FIG. 6, when a tempo interrupt is applied, the count value of TCNT is upped by "1" in Step 60. And, processing moves over to Step 62, wherein whether the count value of TCNT is "32" is checked to thereby make the judgment as to whether or not one whole bar is finished. Since the count value of "31" has been set initially in TCNT as stated previously, it will be noted that, at the initial tempo interrupt following the turn-off of the start switch, the count value of this TCNT becomes "32" in Step 60. For this reason, the judgment "one bar is finished" (Y) is made, and processing now moves over to Step 64.

In Step 64, TCNT is cleared. And, processing moves over to Step 66, wherein the count value of BCNT is upped by "1".

Next, in Step 68, by checking whether the count value of BCNT is "8", judgment is made as to whether the 8-th bar is finished. Since the count value of BCNT has been set to "7" as stated above, it should be noted that, at the initial tempo interrupt, the count of BCNT assumes the value of "8" in Step 66. For this reason, in the judgment in Step 68, there is given the judgment that the 8-th bar is finished, and then processing moves onto Step 70.

In Step 70, BCNT is cleared, and thereafter processing moves over to Step 72. It should be noted here that, in case the judgment in Step 68 is that the 8-th bar is not finished (N), processing moves over to Step 72 without passing through Step 70.

In Step 72, based on the rhythm data stored in RNOREG, the chord type data registered in TYPREG and also on the count value of the counter BCNT, an accompaniment pattern (segment) data is read out from the accompaniment segment memory of the accompaniment data memory unit 18, and this data is written in PTNOREG. As an example, let us assume here that, as described above, the count value of BCNT is "0" and that the rhythm data and the chord type data designate the specific series of accompaniment pattern data shown in FIG. 2A. Then, from the accompaniment segment memory of the accompaniment data memory unit 18 is read out the pattern (segment) data corresponding to the initial bar shown in FIG. 2A (that is, in this example, the data indicative of the coded pattern or segment name A), and this is written in PTNOREG. Thereafter, processing moves over to Step 74. It should be understood that, in case the judgment in Step 62 is such that the initial bar is not finished (N), processing moves over to Step 74 without goint through Steps 64~72.

In Step 74, whether the count value of TCNT corresponds to either one of "0", "4", "8", "12", "16", "20", "24" and "28" is checked to make the judgment whether or not the 8-th note timing is indicated. As an example, let us assume here that the count value of TCNT is "0" as a result of this counter having been cleared. Then, the result of judgment in Step 74 becomes affirmative (Y), and processing moves over to Step 76.

In Step 76, based on the following respective data, i.e. the pattern (segment) data registered in PTNOREG, the rhythm data stored in RNOREG, the chord type data contained in TYPREG and the count value of TCNT, alignment sequence data for four notes are read out sequentially from the alignment sequence memory of the accompaniment data memory unit 18, and this data is written in DREG. As an example, let us here assume, as in the above instance, that the data contained in PTNOREG indicates the accompaniment pattern A and also that the count value of TCNT is "0". Then, from the alignment sequence memory of the accompaniment data memory unit 18 are read out accompaniment segment alignment sequence data T11~T14 for four notes shown in FIG. 3, and these data are written in DREG.

Next, processing moves over to Step 78. Here, whether the LSB of the delay data DLY of the initial note registered in DREG is "1" is checked, and thereby judgment is made whether the Shift Mode is indicated. As an example, if the data stored in DREG are the specific data T11~T14 (data for the Normal Mode) shown in FIG. 3 as stated above, the result of judgment in Step 78 becomes negative (N), and processing moves onto Step 80.

In Step 80, SMFLG is reset. And, processing moves over to Step 82 wherein whether SMFLG is "1" is judged. In this instance, however, SMFLG has been reset already in the preceding Step 80, so that the result of judgment becomes negative (N), and processing moves over to Step 84.

In Step 84, based on the data indicative of the value of the delay data DLY being "0" among the date for four notes stored in DREG and also on the key depression data registered in LKREG, accompaniment tones are generated. And, along therewith, the data that the value of DLY is "0" is erased out of the contents registered in DREG. In this case, the selection as to which one of the key depression data stored in LKREG is to be used for the generation of the accompaniment tones is determined by the tone pitch position data PTH for the data indicating that the DLY value is "0". As an example, if the data contained in DREG are T11~T14 as stated above, and if the DLY value of T14 among them is "0", the key depression data contained in LKREG is read out in accordance with the tone pitch position data PTH of this specific data T14, and this data is supplied to the accompaniment tone forming circuit 26, and thus accompaniment tones corresponding to the abovesaid key depression data are generated. More specifically, if the tone pitch position data PTH of the data T14 is assumed to indicate the position of, for example, "4th", there is read out from LKREG a key depression data for four notes registered in LKREG, and based thereon an accompaniment tone corresponding thereto is generated. And, the data T14 is erased out of DREG. It should be noted here that, if in this case LKREG contains no key depression data corresponding to the position "4th", no accompaniment tone is generated. Also, the tone which is sounded out is not limited to a single tone, but it is possible to sound out a maximum of four notes at the same time.

Thereafter, processing moves back to the routine of FIG. 5. And, when a next tempo interrupt calls, the routine of FIG. 6 is started again, and such a series of processing as described above are repeated.

In the above-described case, the judgment in Step 62 indicates that a length of time corresponding to the duration of only a 32nd note has elapsed from the beginning of one bar, so that the result of judgment becomes negative (N), and processing moves over to Step 74. And, in the judgment made in Step 74, the timing is not that of the 8-th note, and therefore the result of judgment becomes negative (N), and with this processing moves over to Step 86.

In Step 86, with respect to the four notes' data contained in DREG, the value of the delay data DLY is checked, and if the value thereof is not "0", "1" is deducted from each of the delay data. Since, at the preceding interrupt, the data indicating the value of DLY "0" has been erased out in Step 84, it should be noted that, at the instant tempo interrupt, the data of DLY value "0" should no longer be present in DREG. Therefore, if there should be remaining, in DREG, any data at all which calls for sounding out, the value of such a DLY data is either "1", "2" or "3", and accordingly "1" is deducted from each of these respective values. As an example, if it is assumed that data T14 is erased out of DREG as described above and also that the data T12 is of a DLY value of "1", the DLY value of this specific data becomes "0" as a result of the processing carried out in Step 86.

Next, processing moves over to Step 84 via Step 82. Since the DLY value of data T12 is "0", a key depression data is read out from LKREG in the same manner as in the preceding instance in accordance with the tone pitch position data of data T12, and an accompaniment tone corresponding to this key depression data is generated. And, data T12 is erased.

In a manner similar to that described above, if, for example, the DLY value of data T11 has been set to "2" and also the DLY value of data T13 has been set to "3" from the very beginning, this DLY value of data T11 becomes "0" at the next interrupt, and the DLY value of data T13 will become "0" also at the tempo interrupt coming next thereto. Accordingly, if assumption is made here that the accompaniment tone based on the data T14 is generated at the timing of $T_0$ of FIG. 4, it is possible to successively generate, following said generation, accompaniment tones corresponding to these key depression data contained in LKREG and designated by data T12, T11 and T13, respectively, at the timings $T_1$, $T_2$ and $T_3$, respectively, of FIG. 4 with a time lag of 32nd note between each timing.

As described above, with respect to data T11, LSB of DLY is used as the mode-indicating bit, so that only "0" or "2" can be given as the value of DLY. With respect to data T12, T13 and T14, however, it is possible to give any arbitrary value from "0" to "3" as the value of DLY. Accordingly, by appropriately selecting the value of DLY of data T11~T14, it is possible to select and set a variety of sounding-out timings in a single 8-th note section.

After completion of tempo interrupts four times for the initial 8-th note of FIG. 3 in a manner as described above, let us here suppose that the initial tempo interrupt is applied for the next 8-th note. Whereupon, the result of judgment in Step 74 becomes affirmative (Y), and processing moves over to Step 76.

In Step 76, data T21~T24 for four notes are read out from the alignment sequence memory of the accompaniment data memory unit 18 in accordance with the count value of "4" of TCNT, and these data are written in DREG.

Next, processing moves over to Step 78, wherein judgment is made as to whether or not the Shift Mode is indicated. Since data T21~T24 are for the Shift Mode, the result of judgment in Step 78 becomes affirmative (Y), so that processing moves over to Step 88.

In Step 88, "1" is set in SMFLG. And, processing moves to Step 82 to judge whether SMFLG is "1". The result of this judgment is affirmative (Y), so that processing moves over to Step 90.

In Step 90, an accompaniment tone is generated based on the data DLY value="0" among the data for four notes stored in DREG, and also on the root note data contained in RTREG. And, the data DLY value="0" is erased. In this case, the tone pitch of the accompaniment tone which is to be sounded out is determined by adding the root note data to the interval data in the data DLY value="0". As an example, if the data contained in DREG are assumed to be T21~T24, and if among them the DLY value of T22 is "0", the data which is obtained by adding this data T22 to the root note data is supplied to the accompaniment tone forming circuit 26, whereby an accompaniment tone corresponding to this added data is generated. And, the data T22 is erased out of DREG.

Thereafter, tempo interrupt is applied three times in a manner similar to that described above with respect to the Normal Mode, and for each interrupt, the respective DLY values are deducted by "1" if the DLY value contained in DREG is not "0", and based on the data DLY value="0" and also on the root note data, an accompaniment tone is generated. It should be noted here that, with respect to the data T21, only "1" or "3" can be assigned as the value of DLY. With respect to data T22~T24, however, any abitrary value of "0"~"3" can be given as the value of DLY. Accordingly, by appropriately selecting the DLY value of data T21~T24, it is possible to set various sounding-out timings in a single 8-th note section.

The accompaniment tone generating processing described above for the consecutive two 8-th notes are carried out, thereafter also, in the same way as mentioned above for each of the following respective 8-th notes. And, when processing advances to the second bar following the completion of the series of processing for one bar which corresponds to the accompaniment pattern A, a segment (pattern) data corresponding to the accompaniment pattern C of FIG. 2A is written in PTNOREG in Step 72, and in a manner similar to that described above, a series of processing of Step 74 and of subsequent Steps are carried out to read out data concerning the accompaniment segment alignment sequence corresponding to the accompaniment pattern C, to thereby control the generation of accompaniment tones. Such a series of processing for each bar are repeated in the same manner up to the 8-th bar. And, when, in Step 68, judgment is made that the 8-th bar is finished, the processing returns to the initial bar, and a series of similar processing for eight bars are repeated.

As described above, according to the present invention, there are stored data representing a plurality of accompaniment segments which form a plurality of mutually different accompaniment patterns of predetermined lengths, and apart from the above, there are stored the orders with which these accompaniment segments are to be aligned sequentially, and as the segment data are read out one after another, these orders of alignment of the read-out segment data are also read out one after another so that the segments thus read out are aligned sequentially, at a given tempo, to generate accompaniment tones. Therefore, by an arbitrary combination of individual accompaniment patterns or segments, it is possible to materialize complicated accompaniment patterns, and in addition it is possible to reduce the amount of data to be stored, by the common use of a same segment in different performance sections.

What is claimed is:

1. An automatic accompaniment apparatus for an electronic musical instrument, comprising:

tempo clock generating means for generating tempo clock pulses for controlling the tempo of an automatic accompaniment performance;

accompaniment segment memory means for storing segment data representing a predetermined arrangement of a plurality of accompaniment segments which make up an accompaniment pattern of a predetermined length;

alignment sequence memory means for storing order data representing notes of said accompaniment segments and order in which said notes of said accompaniment segments are to be aligned sequentially;

segment read out means for reading out said segment data in accordance with the predetermined arrangement;

alignment sequence read out means for reading out order data corresponding to a presently designated accompaniment segment of the segment data and in accordance with said tempo clock pulses thereby to align the read out order data to the tempo of the accompaniment performance;

note designating means for designating at least one music note; and accompaniment tone generating means for generating an accompaniment tone in accordance with said read order data and notes designated by said note designating means.

2. An automatic accompaniment apparatus as defined in claim 1 wherein said note designating means includes a keyboard having a plurality of keys each corresponding to a different music note.

3. An automatic accompaniment apparatus as defined in claim 1 further comprising root note detecting means for detecting a root note of a chord represented by said designated notes and wherein said accompaniment tone generating means includes means for generating an accompaniment tone in accordance with said read out order data and the detected root note.

4. An automatic accompaniment apparatus as defined in claim 3 wherein said order data includes data representing an interval on a music scale in reference to said detected root note and wherein the accompaniment tone generating means generates the accompaniment tone in accordance with said interval data and the root note.

5. An automatic accompaniment apparatus as defined in claim 1 wherein said accompaniment tone generating means includes means for generating an accompaniment tone in accordance with a note specified by the order data from among the designated notes from the note designating means.

6. An automatic accompaniment apparatus as defined in claim 1 wherein said segment read out means includes means for reading out said segment data selectively in accordance with said designated notes.

7. An automatic accompaniment apparatus as defined in claim 1 further comprising chord type detecting means for detecting the type of chord represented by the designated notes, wherein said segment read out means includes means for reading out said segment data selectively in accordance with the detected chord type.

8. An automatic accompaniment apparatus as defined in claim 1 further comprising rhythm selecting means for selecting a desired music rhythm type, wherein said segment read out means includes means for reading out said segment data selectively in accordance with the selected rhythm type.

9. An automatic accompaniment apparatus as defined in claim 1 wherein said alignment sequence read out means includes means for reading out said order data selectively in accordance with said designated notes.

10. An automatic accompaniment apparatus as defined in claim 1 further comprising chord type detecting means for detecting the type of chord represented by said designated notes, wherein said alignment sequence read out means includes means for reading out said order data selectively in accordance with the detected chord type.

11. An automatic accompaniment apparatus as defined in claim 1 further comprising rhythm selecting means for selecting a desired music rhythm type, wherein said alignment sequence read out means includes means for reading out said order data selectively in accordance with the selected rhythm type.

12. An automatic accompaniment apparatus as defined in claim 1 wherein said tempo clock pulses are generated at a time period corresponding to an eighth note.

13. An automatic accompaniment apparatus as defined in claim 12 wherein said accompaniment tone generating means includes delay means for delaying said order data by a duration corresponding to a sixteenth note whereby said accompaniment tone is generated at a timing of the sixteenth note.

14. An automatic accompaniment apparatus as defined in claim 1 wherein said accompaniment segments each consists of a length of music score corresponding to at least one measure.

15. An automatic accompaniment apparatus as defined in claim 1 wherein said tempo clock pulses are generated at a period corresponding to a thirty-second note.

16. An automatic accompaniment apparatus for an electronic musical instrument comprising:

tempo clock generating means for generating tempo clock pulses for controlling the tempo of an automatic accompaniment performance;

accompaniment segment memory means for storing segment data representing a predetermined arrangement of a plurality of accompaniment segments which make up an accompaniment pattern of a predetermined length;

alignment sequence memory means for storing, separately from said segment data, order data representing notes of said accompaniment segments and order in which said notes of said accompaniment segments are to be aligned sequentially;

segment read out means for reading out said segment data in accordance with the predetermined arrangement as the order data is read out from said alignment sequence memory means;

alignment sequence read out means for reading out order data corresponding to a presently designated accompaniment segment of said segment data and in accordance with said tempo clock pulses thereby to align the read out order data to the tempo of the accompaniment performance; and accompaniment tone generating means for generating an accompaniment tone signal in accordance with the order data derived from the alignment sequence memory means which corresponds to an accompaniment segment designated in the segment data.

17. A method of automatically producing accompaniment in an electronic musical instrument, comprising the steps of:

storing segment data representing a predetermined arrangement of a plurality of accompaniment segments which make up an accompaniment pattern of predetermined length;

storing order data representing notes of said accompaniment segments and order in which said accompaniment segments are to be aligned sequentially;

generating tempo clock pulses corresponding to the tempo of desired music accompaniment performance;

reading out stored accompaniment segment data in accordance with the predetermined arrangement;

reading out stored order data corresponding to a presently designated accompaniment segment of said segment data and in accordance with the tempo clock pulses thereby to align the read out order data to the tempo or the accompaniment performance; and generating an accompaniment tone in accordance with the resulting aligned order data.

18. A method of automatically producing accompaniment as defined in claim 17 wherein the steps of reading out segment data includes:

providing a keyboard having a plurality of keys each corresponding to a different music note;

depressing a key to designate a note; and reading out the segment data selectively in accordance with the designated note.

19. A method of automatically producing accompaniment as defined in claim 18 further comprising the steps of:

selecting a rhythm type; and generating the accompaniment tone in accordance with the selected rhythm type.

20. A method of automatically producing accompaniment as defined in claim 17 wherein the steps of reading out order data includes:

providing a keyboard having a plurality of keys each corresponding to a different music note;

depressing a key to designate a note; and reading out the order data selectively in accordance with the designated note.

21. A method of automatically producing accompaniment as defined in claim 20 further comprising the steps of:

selecting a rhythm type; and generating the accompaniment tone in accordance with the selected rhythm type.

* * * * *